United States Patent [19]

Andeen

[11] 4,404,808

[45] Sep. 20, 1983

[54] CRYOGENIC REFRIGERATOR WITH NON-METALLIC REGENERATIVE HEAT EXCHANGER

[75] Inventor: Bruce R. Andeen, Acton, Mass.

[73] Assignee: Helix Technology Corporation, Waltham, Mass.

[21] Appl. No.: 291,517

[22] Filed: Aug. 10, 1981

[51] Int. Cl.[3] ..... F25B 9/00

[52] U.S. Cl. ..... 62/6; 165/10

[58] Field of Search ..... 62/6; 165/10

[56] References Cited

U.S. PATENT DOCUMENTS

| | | | |
|---|---|---|---|
| 2,781,647 | 2/1957 | Kohler et al. | 62/136 |
| 2,898,091 | 8/1959 | Verbeek | 257/262.1 |
| 2,958,935 | 11/1960 | Bloem | 29/157.3 |
| 3,397,738 | 8/1965 | Daunt | 165/10 |
| 3,678,992 | 7/1972 | Daniels | 62/6 |
| 3,692,099 | 9/1972 | Nesbitt et al. | 165/10 |
| 3,765,187 | 10/1973 | Horn | 62/6 |
| 3,794,110 | 2/1974 | Severijns | 62/6 |
| 3,960,204 | 6/1976 | Horn | 165/4 |
| 4,143,520 | 3/1979 | Zimmerman | 62/6 |
| 4,206,609 | 6/1980 | Durenec | 62/6 |
| 4,259,844 | 4/1981 | Sarcia et al. | 62/6 |

OTHER PUBLICATIONS

Balas et al.: "The Sterling Cycle Cooler: Approaching One Year of Maintenance-Free Life", *Advances in Cryogenic Engineering,* vol. 23, 1978.

Scott, "Cryogenic Engineering", 1959, pp. 322-323, 326-330.

*Primary Examiner*—Ronald C. Capossela

*Attorney, Agent, or Firm*—Hamilton, Brook, Smith and Reynolds

[57] ABSTRACT

A refrigerator for operating at cryogenic temperatures which has a heat exchanger comprising a previous regenerative matrix of plastic material, the elements of which behave substantially as isothermal bodies.

12 Claims, 10 Drawing Figures

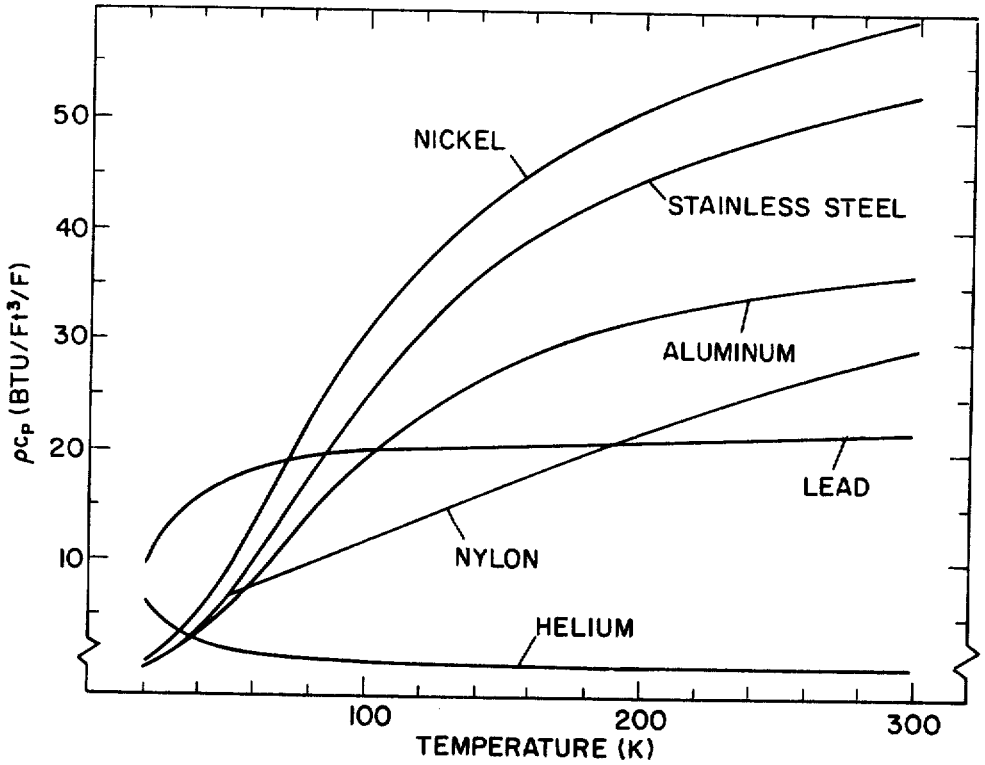
FIG. 1
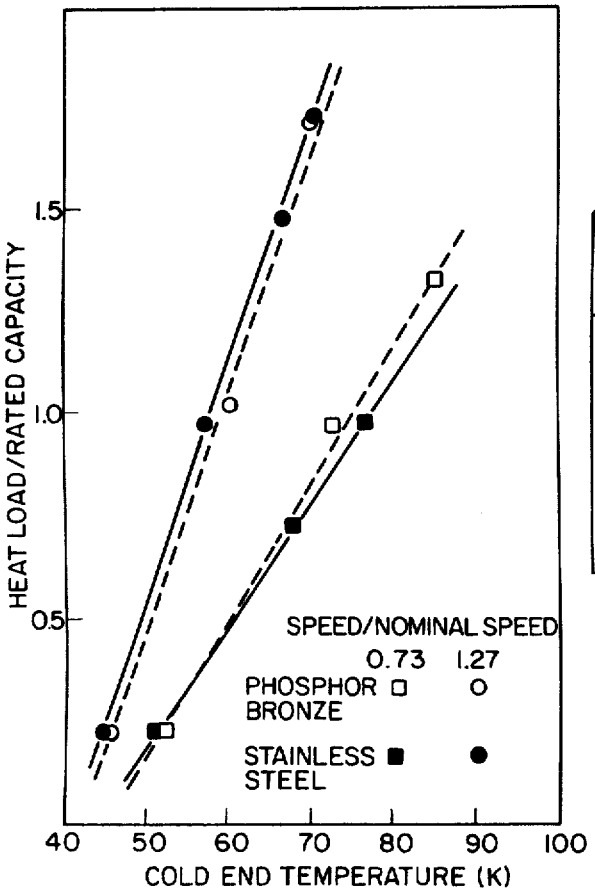
FIG. 3
| MATERIAL | REGENERATOR LOSS (WATTS) | | |
|---|---|---|---|
| | CONDUCTION | FLOW | EFFECTIVENESS |
| STAINLESS STEEL | 0.149 | 0.701 | 0.930 |
| PHOSPHOR BRONZE | 0.187 | 0.701 | 0.927 |
| NICKEL | 0.201 | 0.701 | 0.926 |
| LEAD | 0.179 | 0.701 | 0.960 |
| NYLON | 0.038 | 0.701 | 0.969 |
FIG. 2

CRYOGENIC REFRIGERATOR WITH NON-METALLIC REGENERATIVE HEAT EXCHANGER

TECHNICAL FIELD

This invention is in the field of refrigeration systems operating at cryogenic temperatures and more particularly relates to systems which develop refrigeration through the expansion of a compressed fluid and incorporate one or more regenerative heat exchangers. The invention herein described was made in the course of or under a contract with the Air Force.

BACKGROUND OF THE INVENTION

There are numerous systems in use today for producing cryogenic temperatures. As used herein "cryogenic" temperatures will be defined as temperatures below −150° C. (123.16° K.). This is the value assigned by Russell B. Scott in *CRYOGENIC ENGINEERING* published by D. Van Nostrand Co., Inc., Princeton, N.J. in 1966 as follows:

> "It is rather difficult to assign a definite temperature which will serve as the dividing point between refrigerating and cryogenic engineering, but it will probably conform to present usage to say that cryogenic engineering is concerned with temperatures below −150° C. Another equally acceptable division is to assign to cryogenic engineering the temperature region reached by the liquefaction of gases whose critical temperatures are below terrestrial temperatures".

Some of the better known cyclicly operating cryogenic systems are the integral and the split Stirling, the Gifford-McMahon and the integral and the split Vuilleumier. Each system operates through the expansion of a compressed fluid and incorporates one or more regenerative heat exchangers which generally comprises a housing with a heat exchanging matrix contained inside. The matrix absorbs heat from a high pressure fluid, usually helium, which flows in a first direction. Heat is stored for a short period and is then transferred back to the fluid, which is at a lower temperature due to expansion, when the fluid is made to flow in the opposite direction, thus completing one cycle. The heat exchange process between the gas and the matrix is essential to the achievement of cryogenic temperatures.

Many applications of cryogenic refrigeration are found today in high technology, highly reliable, long term continuous duty apparatus. Some examples of such apparatus are mazers and parametric amplifiers in communication systems such as satelite or missile tracking systems; superconducting computer circuitry; and high-field-strength superconducting magnets. In such usage efficiency and reliability of the highest order of magnitude is required, and considerations of weight, cost, size and ease of manufacturing are often subordinated to performance and reliability.

As part of the sophisticated technology employed to produce utmost dependability and the highest efficiency, much effort has been devoted to the selection of materials for the regenerative heat exchangers in cryogenic refrigerators. Those which exhibit high volumetric heat capacities at low temperatures are normally preferred. Furthermore, considerable effort has been devoted to the forming or shaping of the heat exchanger matrices after the material has been selected.

Materials often found in cryogenic refrigerating systems include copper, gold, lead, stainless steel, bronze, mercury-lead alloys, nickel, etc. (see U.S. Pat. Nos. 3,397,738, 3,216,484). These metals are intricately fabricated into matrices which can assume various configurations of matrix elements. Some of these are tiny balls or beads, layers of fine wire gauze or mesh, metal wool and stacked perforated disks or plates, to name a few. These metals are not only generally heavy, but they are expensive and the fabrication process necessary to create the matrix is expensive.

SUMMARY OF THE INVENTION

Quite a different set of criteria occur when cryogenic refrigerators are to be employed in large numbers in airborne applications. The refrigerators must be small, lightweight, inexpensive and their parts readily fabricated in mass production. With these as objectives and to this usage the present invention is primarily directed.

Applicant has found that the heat exchanging elements of regenerative heat exchangers which operate at cryogenic temperatures may be a matrix of lightweight, inexpensive, readily obtained plastic material.

As used herein, plastic is defined as:

> "A material that contains as an essential ingredient, an organic substance of large molecular weight, is solid in its finished state, and, at some stage in its manufacture, or in its processing into finished particles, can be shaped by flow (definition from ASTM D883-54T)" as defined in the Condensed Chemical Dictionary, Sixth Edition published by Reinhold Publishing Corporation.

Applicant has also found that the net performance of refrigerators or coolers operating at cryogenic temperatures can be insensitive to the regenerator material and believes it requires the matrix elements to behave substantially as isothermal bodies.

Plastic such as nylon and polypropylene in the form of balls or beads and mesh, etc. is readily available commercially, and can be employed as matrices with little or no fabrication. Furthermore, they have adequate volumetric heat capacity and thermal conductivity to effectively operate at cryogenic temperatures. Because plastics generally have less thermal conductivity than metals they will produce smaller axial conductor losses in regenerative heat exchangers. Other advantages that plastic matrices have are, that they are lightweight and inexpensive. The effectiveness of plastic regenerators is contrary to the heretofore widely held belief that relatively heavy expensive metals had to be used as a matrix of a regenerative heat exchanger.

BRIEF DESCRIPTION OF THE DRAWINGS

The present invention comprises the above and other features which will now be more particularly described with reference to the accompanying drawings and pointed out in the claims. It will be understood that the particular refrigeration system embodying the invention is shown by way of illustration only and not as a limitation of the invention. The principles and features of this invention may be employed in various and numerous embodiments and in conjuction with our system without departing from the scope of the invention.

FIG. 1 is a diagram of the volumetric heat capacity of various materials including nylon;

FIG. 2 is a chart of predicted regenerator losses in materials made in the form of mesh regenerators at a cold temperature of 80° K.;

FIG. 3 is a chart of experimental performance of metallic mesh regenerative heat exchangers;

BEST MODE OF CARRYING OUT THE INVENTION

Figure 4:
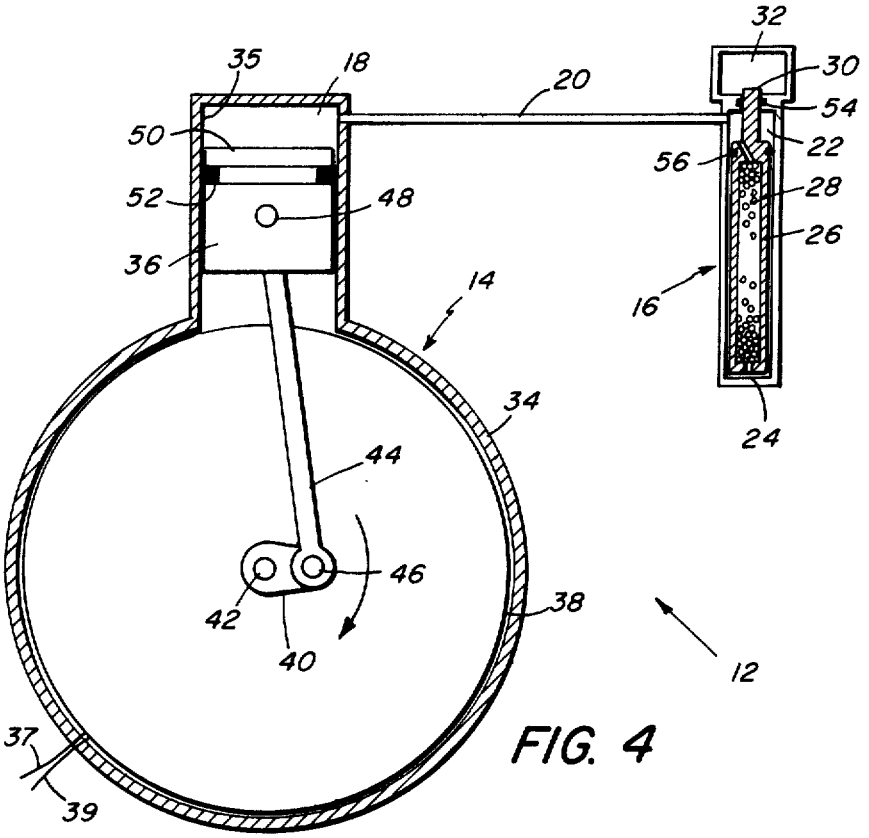
FIG. 4 is a schematic of a split Stirling refrigerator system embodying the present invention.
Figure 10:
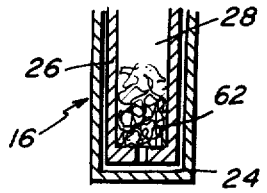
FIGS. 9 and 10 are modifications of the invention in which the regenerative heat exchanger is made up of a matrix comprising plastic mesh and plastic wool respectively.

In an ideal regenerator, at any given point along the axis of the regenerator, variation in regenerator temperature is small in comparison to that of the gas. By an energy balance, the heat capacity rates and and temperature changes of the regenerator and gas are related by:

$$C_r\Delta T_r = C_g\Delta T_g \quad (1)$$

where $C_r$ and $C_g$ are the heat capacities of the regenerator and the gas, respectively, and $T_r$ and $T_g$ are the temperatures of the regenerator and the gas, respectively. Desiring $\Delta T_r << \Delta T_g$ requires that $$C_r >> C_g \quad (2)$$

or $$(\rho c_p V/t)_r >> (\rho c_p V/t)_g \quad (3)$$

where $V_r$ and $V_g$ are, respectively, the volume of regenerator active in the cyclic regenerative heat transfer, and the volume of gas processed by the regenerator (or roughly the cold end swept volume). t is the time for the thermal interaction, $\rho$ is the density and $c_p$ is the specific heat.

The volumetric heat capacity ($\rho c_p$) of metals is a strong function of both temperature and the material. The wide disparity in $\rho c_p$ between different materials including nylon is shown in FIG. 1. Also shown is the volumetric heat capacity of helium. Helium is used almost exclusively as the working fluid in closed cycle cryogenic refrigerators because of its inertness, relative availability and low critical temperature. Equation 3 leads one to believe that the higher the volumetric heat capacity, the better the regenerator performance. From FIG. 1, a popular decision is the use of nickel for the regenerator matrix material.

However, the regenerator performance is not a direct function of $C_r/C_g$. It has been shown by Kays, W. M. and London, A. L., Compact Heat Exchangers, FIGS. 1–34, McGraw-Hill Book Co., New York, 1964, that the regenerator effectiveness is a weak function of $C_r/C_g$ if $C_r/C_g$ is large.

FIG. 1 shows that at most temperatures the volumetric heat capacity of the metals greatly exceeds the volumetric heat capacity of the helium. As long as $V_r$ is about equal to or greater than $V_g$ (see equation 3), a large $C_r/C_g$ is virtually guaranteed. Thus it can be expected that all the materials in FIG. 1 would make accepttable regenerators in temperature ranges where their heat capacities greatly exceed that of helium unless:

(a) The cold expansion volume is large with respect to the total regenerator volume.

(b) The regenerator cycle time is small with respect to the time constant of the regenerator material, causing strong thermal gradients to appear in the matrix element.

If strong thermal gradients appear in the matrix elements of the regenerator material, the gas is not thermally interacting with the entire matrix mass which essentially reduces the effective regenerator volume. The matrix elements are the individual elements making up the matrix mass i.e. balls, beads or filaments of a mesh etc. with their minimum diameter being a critical contributor to isothermal behavior. At element sizes and cycle rates typical of current coolers (100–1500 CPM), metals have sufficiently high thermal conductivities that they behave essentially as isothermal bodies. Materials with low conductivities (plastics, etc.) will experience a reduction in the effective volume at high cycle rates and/or large matrix characteristic dimensions.

In substantiation of all of the above, modeling of a Stirling cycle cryogenic refrigerator established certain observations. The model assumes that the matrix elements behave as isothermal bodies. The loss mechanisms of the regenerative heat exchanger are regenerator ineffectiveness, resistance to gas flow, and axial thermal conduction. See FIG. 2 for these modeled predicted losses for different regenerator materials which assumed the use of a mesh regenerator and a cold temperature of 80° K.

FIG. 2 lists the model's predicted losses for different wire mesh regenerator material for a typical machine. The only difference between cases is the regenerator material. Several interesting observations may be made from FIG. 2.

a. The losses due to the regenerator pressure drop are identical: the pressure drop is a function of the matrix geometry, not material, and only the material was changed.

b. The losses due to the regenerator effectiveness are all within 5% of each other. Hence, all the regenerators have about the same effectiveness.

c. Those materials that exhibit high $\rho c_p$'s generally are also good conductors. Therefore a smaller loss due to the regenerator ineffectiveness is usually balanced by a larger loss due to conduction down the regenerator stack. The sum of these two losses is essentially constant.

d. The one non-metal listed has a predicted net performance superior to all others, primarily because of the low axial conduction loss. However, for the cycle rate examined, a nylon element would fail to behave as an isothermal body. The regenerator loss is therefore underestimated.

Particulate regenerators exhibited the same trends. The result is that the net performance of typical small cryogenic coolers is insensitive to the regenerator material, so long as the matrix elements behave as isothermal bodies. Hence the use of plastics is limited to lower cycle rates and/or smaller gas volumes than could be used with metallics.

Experimental testing was performed using a small Stirling cycle machine whose swept volume was small in comparison to the regenerator volume. Variables in the experimental program were: the regenerator matrix, the system cycle rate, and the charge pressure.

FIG. 3 illustrates the experimental results using a phosphor bronze and a stainless steel mesh regenerator. Performance is plotted as the experimental load normalized with respect to the rated capacity of the test unit. The only experimental change in the system was the material composing the matrix. System variances include the tolerancing between the two different screens, the variation in working pressure and repeatable accuracy of the test apparatus in general.

Since phosphor bronze has a significantly larger volumetric heat capacity at low temperatures than stainless, traditional thinking would conclude that phosphor bronze would perform substantially better. Rather, the regenerators perform essentially the same. In fact, under those operating conditions which should emphasize the differences between the matrix materials (e.g. high working pressures where $C_r/C_g$ becomes smaller; and high operating speeds which would emphasize the difference in thermal diffusivities) the performances were identical. As shown analytically, this experimentally substantiates that regenerator performance can be insensitive to matrix material.

Experiments were also run using both lead and nylon particulate regenerators. The lead particles were spherical to a reasonable degree, but the manufacturing process for the nylon particles yielded rounded beads, but not necessarily spherical.

Applicant observed that at low regenerator cycle speeds nylong particulate regenerators actually perform better than lead. However, with increasing speeds, performance of both regenerators improved up to a point beyond which nylon degraded and lead continued to improve. Applicant believes that at this point the nylon particles began to fail to act as isothermal bodies. Because large bodies behave less isothermally than small bodies, applicant also believes that particle size can impair performance.

Applicant has thus concluded that:

a. Regenerator effectiveness is a weak function of the matrix material as long as the matrix elements behave substantially as isothermal bodies because the heat capacity rate ratio can be large; and b. Materials for a cryogenic regenerative heat exchanger should be chosen primarily for their availabillity and tolerancing in the desired size unless the objective of producing temperatures approaching absolute 0 predominates over all others.

The above principles are now to be illustrated as embodied in a Stirling cycle refrigerator or cooler.

A split Stirling refrigeration system 12 is shown in FIG. 4. This system includes a reciprocating compressor 14 and a cold finger 16. The compressor provides a sinusoidal pressure variation in a pressurized refrigeration gas, preferably helium, in the space 18. The pressure variation is transmitted through a helium supply line 20 to the cold finger 16.

Within the cylinder of the cold finger 16 a cylindrical displacer 26 is free to move upwardly and downwardly (as viewed in the Figs.) to change the volumes of the warm space 22 and the cold space 24 within the cold finger. The displacer 26 houses a regenerative heat exchanger 28 having a matrix made up of a particulate mass of matrix elements comprising nylon beads having a particle size of about 0.006 to about 0.012 inches. The balls are rounded, but not necessarily perfectly spherical. Helium is free to flow through the regenerator, passing through the matrix 28 of nylon balls located between the warm space 22 and the cold space 24. As will be discussed below, a piston element 30 extends upwardly from the displacer 26 into a gas spring volume 32 at the warm end of the cold finger.

The compressor 14 includes a gas tight housing 34 which encloses a reciprocating piston pump element 36 driven through a crank mechanism from an electric motor 38. The crank mechanism includes a crank arm 40 fixed to the motor drive shaft 42 and a connecting arm 44 joined by pins 46 and 48 to the crank arm and piston. Electric power is provided to the motor 38 from leads 39 through a fused ceramic feedthrough connector 37. The piston 36 has a cap 50 secured thereto. The piston 36 and cap 50 define an annular groove in which a seal 52 is seated. Heat of compression and heat generated by losses in the motor are rejected to ambient air by thermal conduction through the metal housing 34.

The refrigeration system of FIG. 4 can be seen as including three isolated volumes of pressurized gas. The crankcase housing 34 is hermetically sealed to maintain a control volume of pressurized gas within the crankcase below the piston 36. The piston 36 acts on that control volume as well as on a working volume of helium gas. The working volume of gas comprises the gas in the space 18 at the upper end of the compressor cylinder 35, the gas in the supply line 20, and the gas in the spaces 22 and 24 and in the regenerator 28 of the cold finger 16. The third volume of gas is the gas spring volume 32 which is sealed from the working volume by a piston seal 54 surrounding the drive piston 30.

Operation of the split Stirling refrigeration system of FIG. 4 can be best understood with reference to FIGS. 5–8. At the point in the cycle shown in FIG. 5, the displacer 26 is at the cold end 24 of the cold finger 16 and the compressor is compressing the gas in the working volume including the gas in spaces 18, 20, 22 and 24. This compressing movement of the compressor piston 36 causes the pressure in the working volume to rise from a minimum pressure to a maximum pressure. The pressure in the gas spring volume 32 is pre-stablized at some level between the minimum and maximum pressure levels of the working volume. Thus, at a point the increasing pressure in the working volume creates a sufficient pressure difference across the drive piston 30 to overcome the friction of displacer seal 56 and piston seal 54. The piston and displacer then move rapidly upwardly to the position of FIG. 6. With this movement of the displacer, high-pressure helium at ambient temperature is forced through the matrix of nylon balls in the regenerator 28 into the cold space 24. The matrix of nylon beads absorb heat from the flowing pressurized gas and reduces that gas to a cryogenic temperature.

Figure 7:
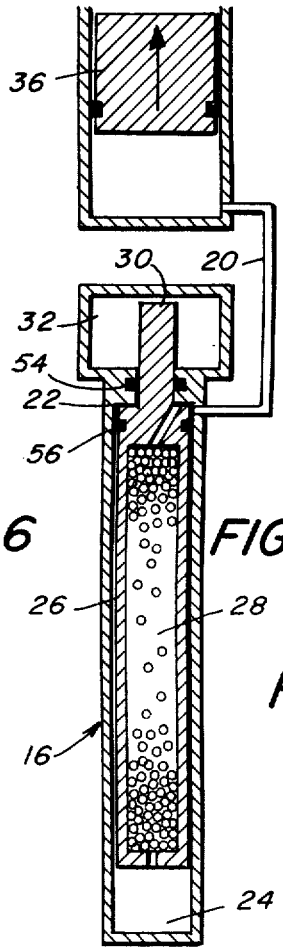
Figure 8:
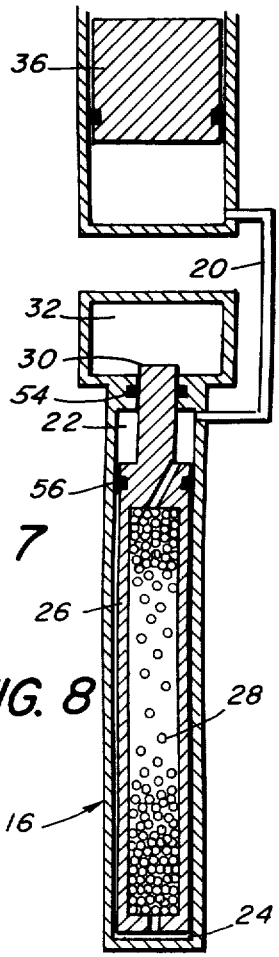

With the sinusoidal drive from the crank shaft mechanism, the compressor piston 36 now begins to expand the working volume as shown in FIG. 7. With expansion, the high pressure helium in the cold space 24 is cooled even further. It is this cooling in the cold space 24 which provides the refrigeration for maintaining a temperature gradient over the length of the regenerator.

At a point in the expanding movement of the piston 36, the pressure in the working volume drops sufficiently below that in the gas spring volume 32 for the gas pressure differential to overcome seal friction. The piston 30 and the displacer 26 are then driven downwardly to the position of FIG. 8, which is also the starting position of FIG. 5. The cooled helium gas in the cold space 24 is thus driven through the regenerator to extract heat from the regenerator matrix.

It should be understood that, as is well known in the art, stroke control means may be provided to assure that the displacer does not strike either end of the cold finger cylinder. Such control means may include one way valves and ports suitably located in the drive piston 30.

As an alternative to nylon balls or beads, the regenerative heat exchanger 28 may be a matrix made up of a particulate mass of matrix elements comprising polypropylene particles e.g. balls or beads with dimensions ranging from about 0.008 inches to about 0.014 inches. The nylon or polypropylene material can be produced by fracturing moulded pellets, followed by tumbling and sieving.

Figure 9:
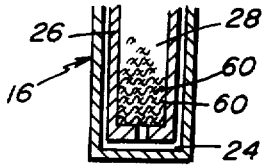
Figure 5:
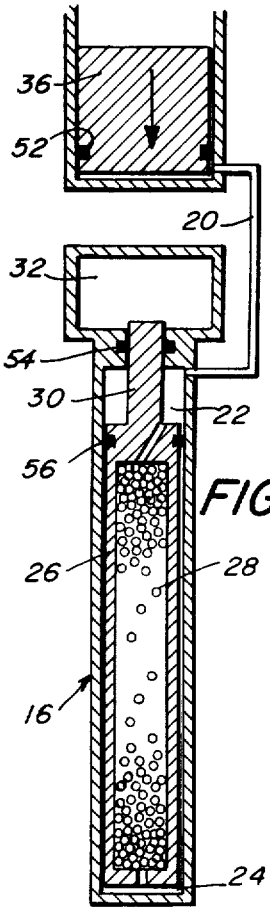
FIGS. 5–8 are simplified schematics of the system of FIG. 1 illustrating four steps in the refrigeration cycle and with a regenerative heat exchanger comprised of a matrix of plastic balls.
Figure 6:
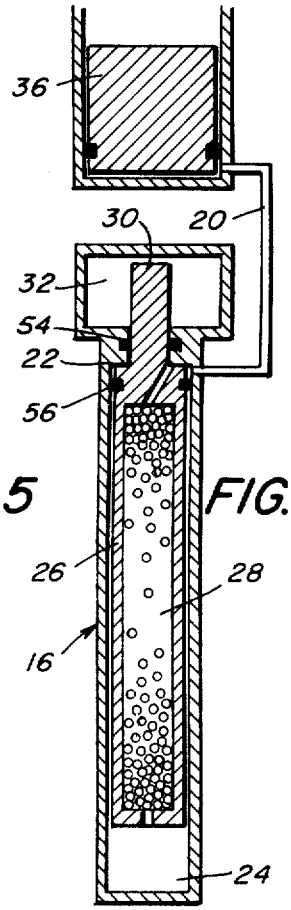

Referring next to FIG. 9, the heat exchanger 28 is shown in an alternative form, as comprising a stack of approximately 760 pieces 60 of size 210 nylon mesh i.e. 210 filaments per linear inch, and with a filament diameter of about 0.0019 inch but having a somewhat compressed screen thickness of 0.003 inch. The weave of the mesh, i.e. the direction of the filaments, is randomly arranged from piece to piece in the stack axially of the cold finger 16.

FIG. 7 shows still another alternative form of regenerative heat exchanger 28 comprising a mass of plastic wool in which the filaments are randomly arranged without any geometric pattern both axially and transversely of the cold finger 16.

I claim:

1. A regenerative heat exchanger for operating at cryogenic temperatures characterized by its regenerative heat exchanging element being a pervious matrix of plastic material.

2. A regenerative heat exchanger for operating at cryogenic temperatures characterized by its regenerative heat exchanging element comprising a pervious displacer containing non-metallic matrix elements which behave substantially as isothermal bodies.

3. The heat exchanger of claims 1 and 2 in which the matrix is a particulate mass of nylon beads.

4. The heat exchanger of claims 1 and 2 in which the matrix is a particulate mass of polypropylene beads.

5. The heat exchanger of claims 1 and 2 in which the matrix is a stack of layers of plastic mesh.

6. The heat exchanger of claims 1 and 2 in which the matrix is a mass of plastic wool.

7. A refrigerator for operating at cryogenic temperatures characterized by having a heat exchanger comprising a pervious regenerative matrix of plastic material.

8. The refrigerator of claim 7 in which the matrix is a particulate mass of nylon beads with dimensions ranging from about 0.006 inch to about 0.012 inch.

9. The refrigerator of claim 7 in which the matrix is a particulate mass of polypropylene beads with dimensions ranging from about 0.006 inch to about 0.014 inch.

10. The refrigerator of claim 7 in which the matrix is a stack of layers of nylon mesh having 210 filaments per linear inch.

11. The refrigerator of claim 7 in which the matrix is a stack of layers of nylon mesh having a filament diameter of about 0.0019 inch.

12. A refrigerator for operating at cryogenic temperatures comprising a compressor, a reciprocating displacer within a cold finger, the displacer being driven in reciprocating motion by the compressor through the medium of a compressable gas and a regenerative heat exchanger in the displacer in communication with the compressed gas comprising a pervious matrix of plastic material.

* * * * *